US007621332B2

(12) United States Patent
Haney et al.

(10) Patent No.: US 7,621,332 B2
(45) Date of Patent: Nov. 24, 2009

(54) APPARATUS AND METHOD FOR PERFORATING AND FRACTURING A SUBTERRANEAN FORMATION

(75) Inventors: Joseph Haney, Dalton Gardens, ID (US); Dan Pratt, Fort Worth, TX (US)

(73) Assignee: Owen Oil Tools LP, Houston, TX (US)

( * ) Notice: Subject to any disclaimer, the term of this patent is extended or adjusted under 35 U.S.C. 154(b) by 104 days.

(21) Appl. No.: 11/252,958

(22) Filed: Oct. 18, 2005

(65) Prior Publication Data

US 2007/0084604 A1 Apr. 19, 2007

(51) Int. Cl.
*E21B 43/117* (2006.01)
*E21B 43/263* (2006.01)

(52) U.S. Cl. ..... 166/298; 166/308.1; 102/320

(58) Field of Classification Search ... 166/308.1–308.3, 166/298, 297; 102/313, 314, 318, 320, 321, 102/322; 89/1.15
See application file for complete search history.

(56) References Cited

U.S. PATENT DOCUMENTS 2,760,434 A * 8/1956 Ruth ..... 102/306
2,766,828 A * 10/1956 Rachford, Jr. ..... 166/299
3,058,522 A * 10/1962 McElheny ..... 175/4.54
3,087,424 A * 4/1963 Levin ..... 181/116
3,659,658 A 5/1972 Brieger
4,018,293 A * 4/1977 Keller ..... 175/4.5
4,122,899 A * 10/1978 Brieger ..... 166/297
4,261,956 A * 4/1981 Adlhart ..... 422/239
4,391,337 A 7/1983 Ford et al.
4,446,920 A * 5/1984 Woytek et al. ..... 166/297
4,456,069 A * 6/1984 Vigneri ..... 166/303
4,475,596 A * 10/1984 Papst ..... 166/303
4,519,313 A * 5/1985 Leidel ..... 102/310
4,657,089 A 4/1987 Stout
4,823,875 A 4/1989 Hill
4,967,840 A * 11/1990 Miller ..... 166/303
5,088,557 A 2/1992 Ricles et al.
5,099,763 A * 3/1992 Coursen et al. ..... 102/313
5,551,344 A 9/1996 Couet et al.
5,598,891 A 2/1997 Snider et al.
5,690,171 A 11/1997 Winch et al.
5,775,426 A 7/1998 Snider et al.
6,082,450 A 7/2000 Snider et al.
6,158,511 A 12/2000 Wesson
6,237,688 B1 5/2001 Burleson et al.
6,263,283 B1 7/2001 Snider et al.
6,336,506 B2 1/2002 Wesson
6,386,288 B1 5/2002 Snider et al.

(Continued)

FOREIGN PATENT DOCUMENTS

WO WO 2005035940 A1 * 4/2005

*Primary Examiner*—Kenneth Thompson
(74) *Attorney, Agent, or Firm*—Mossman Kumar & Tyler PC

(57) ABSTRACT

A device for perforating and fracturing a formation in a single trip includes shaped charges and a volume of a gas generator. When activated by detonation of the shaped charges, the gas generator forms a high-pressure gas, which includes steam, that expands to stress and fracture the formation. Suitable gas generating materials include hydrates and hydroxides. Other materials that can be employed with the gas generator include oxidizers and material such as metals that increase the available heat for the activation of the gas generator.

6 Claims, 3 Drawing Sheets

U.S. PATENT DOCUMENTS

| | | | |
|---|---|---|---|
| 6,426,917 | B1 | 7/2002 | Tabanou et al. |
| 6,439,121 | B1 | 8/2002 | Gillingham |
| 6,494,261 | B1 | 12/2002 | Pahmiyer |
| 6,536,524 | B1 | 3/2003 | Snider |
| 6,755,249 | B2 | 6/2004 | Robison et al. |
| 6,761,219 | B2 | 7/2004 | Snider et al. |
| 6,991,044 | B2 | 1/2006 | Zhang et al. |
| 7,216,708 | B1 | 5/2007 | Bond et al. |
| 7,228,906 | B2 | 6/2007 | Snider et al. |
| 2001/0001418 | A1 | 5/2001 | Wesson |
| 2003/0037692 | A1 | 2/2003 | Liu |
| 2003/0221831 | A1 | 12/2003 | Reddy et al. |
| 2006/0237190 | A1 | 10/2006 | Snider et al. |
| 2007/0084604 | A1 | 4/2007 | Haney et al. |

* cited by examiner

APPARATUS AND METHOD FOR PERFORATING AND FRACTURING A SUBTERRANEAN FORMATION

BACKGROUND OF THE INVENTION

1. Field of the Invention

The present invention relates to an apparatus and method for perforating well casing and/or a subterranean formation. More particularly, the present invention relates to an apparatus and process wherein a propellant is conveyed into a well within a shaped charge.

2. Description of the Related Art

Hydrocarbon producing wells typically include a casing string positioned within a well bore that intersects a subterranean oil or gas deposit. The casing string increases the integrity of the well bore and provides a path for producing fluids to the surface. Conventionally, the casing is cemented to the well bore face and subsequently perforated by detonating shaped explosive charges. These perforations extend through the casing and cement a short distance into the formation. In certain instances, it is desirable to conduct such perforating operations with the pressure in the well being overbalanced with respect to the formation pressure. Under certain overbalanced conditions, the well pressure exceeds the pressure at which the formation will fracture, and therefore, hydraulic fracturing occurs in the vicinity of the perforations. As an example, the perforations may penetrate several inches into the formation, and the fracture network may extend several feet into the formation. Thus, an enlarged conduit can be created for fluid flow between the formation and the well, and well productivity may be significantly increased by deliberately inducing fractures at the perforations.

Techniques for perforating and fracturing a formation surrounding a borehole are known in the art. The common technique of hydraulically pressurizing the borehole to expand or propagate the fractures initiated by the projectile can be expensive due to the preparation required for pressurizing a portion of a borehole. Typically, pressure around a production zone in the borehole is increased by pumping fluids into that portion of the well to obtain the high pressures necessary to expand the fracture in the production zones. This operation is generally time intensive and costly making these techniques unattractive for either multiple zone wells or wells with a low rate of production.

Gas generating propellants have been used in place of hydraulic fracturing techniques to create and propagate fractures in a subterranean formation. In one conventional arrangement, a perforating gun having shaped charges is fitted with a propellant charge and conveyed into the well. This propellant charge may be formed as a sleeve that surrounds a charge tube in which the shaped charges are secured. As is known, flammable or combustible material such as propellants require careful handling during all aspects of manufacture, transportation and deployment. Thus, protective measures are taken throughout all these phases to prevent unintended detonation of the propellant.

Thus, it is one object of this invention to provide methods and systems for safely and efficiently fracturing a well, particularly in connection with a perforation activity. Still other objects will become apparent below.

SUMMARY OF THE INVENTION

The present invention provides devices and methods for safely and efficiently fracturing a formation. In one aspect, these devices and methods are adapted to perforate and fracture the formation in a single trip. An exemplary device for perforating and fracturing a subterranean formation includes shaped charges and a volume of a gas generator (or gas generating material). When activated, the gas generator forms a high-pressure gas that includes steam. The high-pressure gas expands to stress and fracture the formation. The gas generator is activated by a downhole energy source. Suitable gas generating materials include hydrates and hydroxides. Theses classes of material can be activated using thermal energy released by detonation of shaped charges. Other materials that can be employed with the gas generator include oxidizers and material such as metals that increase the available heat for the activation of the gas generator.

In embodiments where the gas generator is used in connection with a perforating gun, one or more parts of the gun can be formed from the gas generator. For example, one or more casings for the shaped charges can be formed from the gas generator. In situations where fracturing is not done in connection with another activity such as perforating, an exemplary device having a volume of a gas generator can be conveyed down using a suitable conveyance device.

The above-recited examples of features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DETAILED DESCRIPTION OF THE INVENTION

As will become apparent below, the present invention provides a safe and efficient device for fracturing a subterranean formation. In aspects, the present invention uses a gas generating material that, when activated, produces a high-pressure gas having a steam component. The steam can be a fraction or substantially all of the high-pressure gas generated. Merely for convenience, suitable materials that decompose to release water will be referred to as steam-producing materials. Exemplary materials include hydrates and hydroxides. Hydrates are compounds formed by the union of water molecules with some a primary material. Common hydrates include gypsum (calcium sulfate dihydrate), barium chloride dihydrate, lithium perchlorate trihydrate and magnesium carbonate pentahydrate. Hydroxides are compounds that contain one or more hydroxyl groups. Common hydroxides include magnesium hydroxide. As should be appreciated, such materials can be manufactured, transported and deployed without the safeguards typically used when handling combustible materials such as propellants. Embodiments utilizing steam-producing material for fracturing are discussed in greater below.

Figure 1:
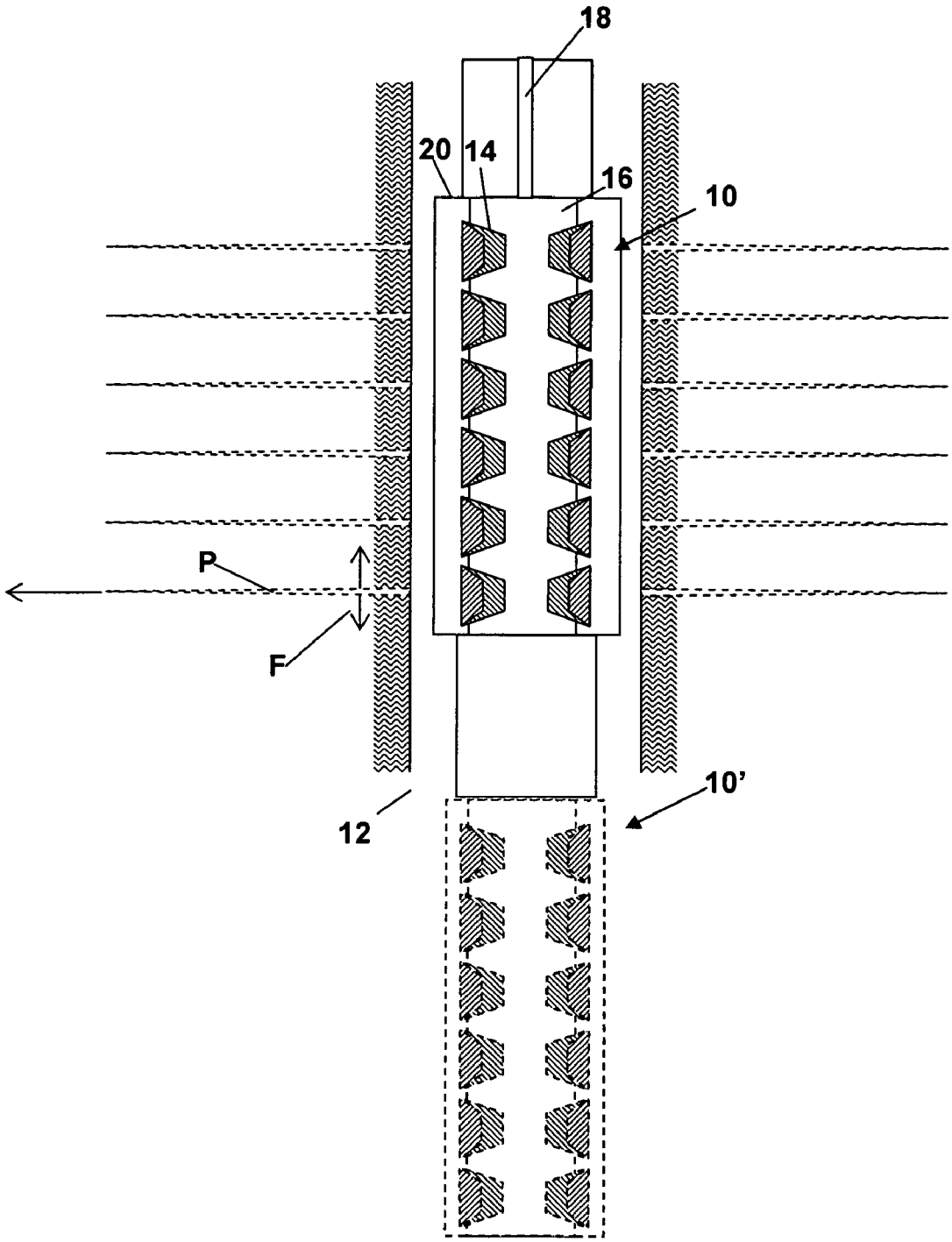
FIG. 1 is a schematic sectional view of one embodiment of an apparatus of the present invention as positioned within a well penetrating a subterranean formation.

Referring initially to FIG. 1, there is shown a perforating gun 10 disposed in a wellbore 12. Shaped charges 14 are inserted into and secured within a charge holder tube 16. A detonator or primer cord 18 is operatively coupled in a known manner to the shaped charges 14. The charge holder tube 16 with the attached shaped charges 14 are inserted into a carrier housing tube 20. Any suitable detonating system may be used in conjunction with the perforating gun 10 as will be evident to a skilled artisan. The perforating gun 10 is conveyed into the wellbore 12 with a conveyance device that is suspended from a rig or other platform (not shown) at the surface. Suitable conveyance devices for conveying the perforating gun 10 downhole include coiled tubing, drill pipe, a wireline, slick line, or other suitable work string may be used to position and support one or more guns 10 within the well bore 12. In some embodiments, the conveyance device can be a self-propelled tractor or like device that move along the wellbore. In some embodiments, a train of guns may be employed, an exemplary adjacent gun being shown in phantom lines and labeled with 10'.

In one embodiment, the perforating gun 10 is configured to perforate and fracture a formation in a single trip, the perforations being enumerated with P and the fracturing action being enumerated with F. As will be described more fully below, the material for producing a high-pressure gas for fracturing the formation 13 is carried in a suitable location along the gun 10.

Figure 2:
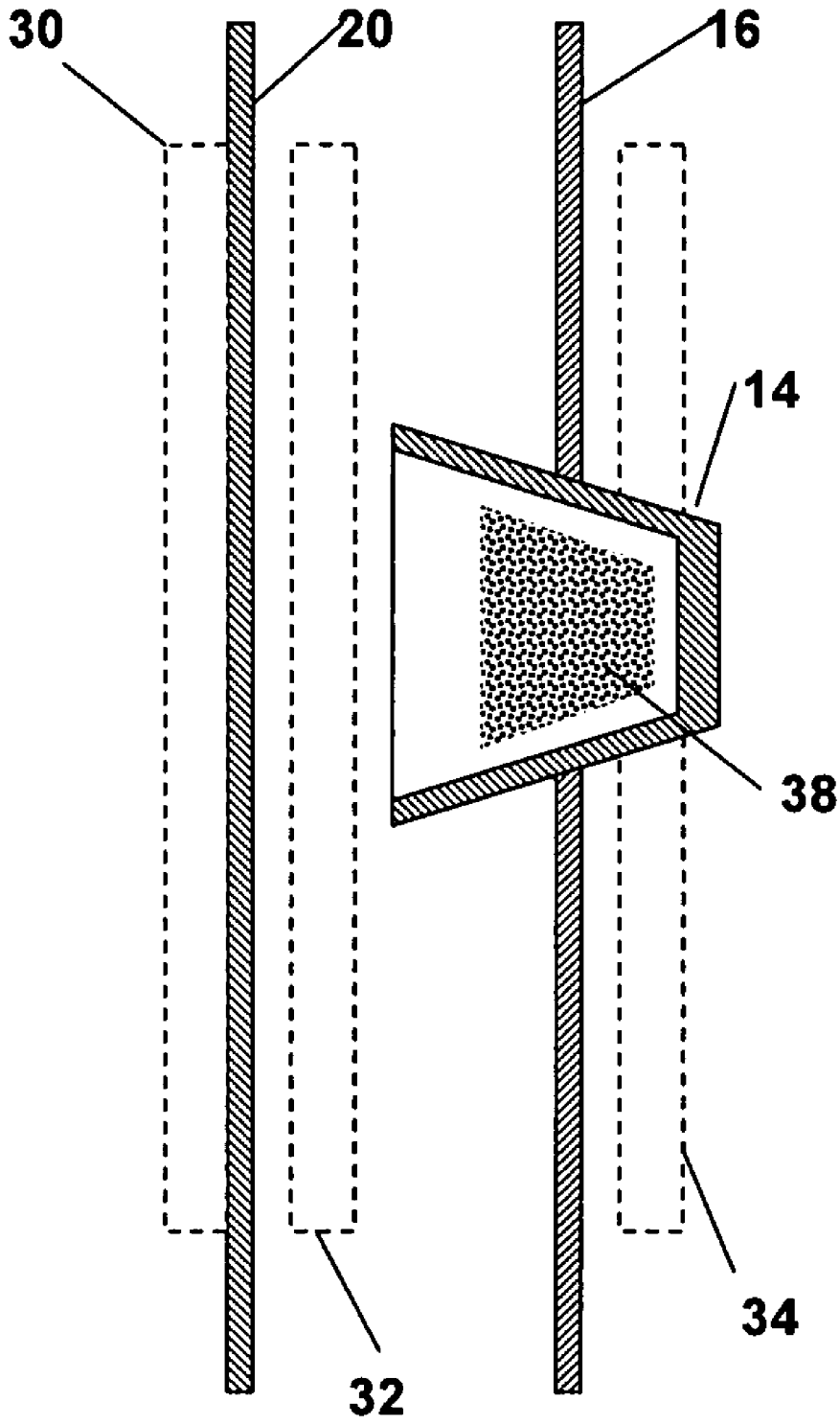
FIG. 2 is a schematic sectional view of a portion of the FIG. 1 embodiment.

Referring now to FIG. 2, there is illustratively shown a section of the perforating gun 10. In FIG. 2, there is sectionally shown the shaped charge 14, the charge tube 16, and the carrier tube 20. In one arrangement, a volume of steam-producing material, shown with dashed lines and labeled 30, can be positioned external to the carrier tube 20. For example, the external volume of steam-producing material 30 can be formed as a sleeve or strip fixed onto the carrier tube 20. In another arrangement, a volume of steam-producing material, shown with dashed lines and labeled 32, can be positioned internally within the carrier tube 20 and external to the charge tube 16. In another arrangement, a volume of steam-producing material, shown with dashed lines and labeled 34, can be positioned internal to the charge tube 16. Additionally, a volume of steam-producing material can be positioned adjacent to the shaped charges 16 such as in an adjoining sub (not shown).

In still other embodiments, one or more elements making up the perforating gun 10 can be formed from the steam-producing material. For example, a casing 36 of the shaped charge 14 can be formed partially or wholly from a steam-producing material. In another arrangement, a volume of steam-producing material 38 can be positioned inside the casing 36. In still other arrangements, the carrier tube 20, charge tube 16 or other component of the perforating gun 10 can be formed at least partially of a steam-producing material.

Figure 3:
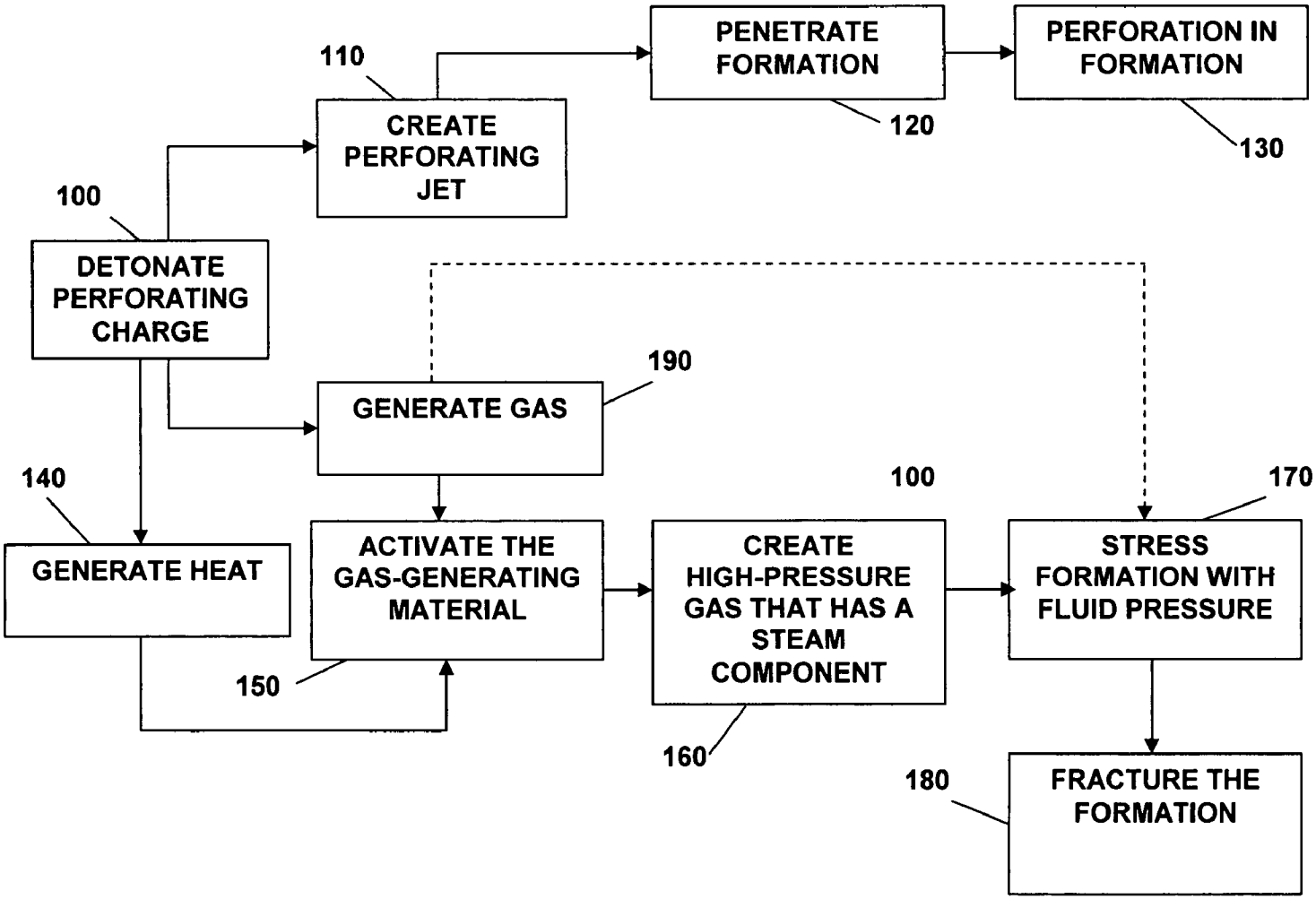
FIG. 3 is a flowchart illustrating embodiments of methods for perforating and fracturing a formation according to the present invention.

Referring now to FIG. 3, there is shown illustrative methodologies for utilizing steam-producing material to fracture a formation. In connection with a perforating gun as shown in FIG. 1, a method for fracturing a formation with steam-producing material can be initiated by detonation of one or more perforating charges at step 100. In a conventional manner, the detonation creates a perforating jet at step 110 that penetrates the formation at step 120 and forms a perforation in the formation at step 130. In one arrangement, the detonation step 100 releases thermal energy at step 140 that activates the steam-producing material at step 150. By activate, it is meant that the steam-producing material undergoes a change in material state or composition. The activated steam-producing material creates a high-pressure gas that has a steam component at step 160. For example, upon application of thermal energy, a hydrate decomposes and releases water that nearly instantly is converted to steam. At step 170, the expansion of the high-pressure gas stresses the wellbore and in particular the perforations made at step 130. At step 180, the formation and in particular the perforations fracture.

In one variant, the detonation step 100 can generate a gas or other material at step 190 that activates the steam-producing material at step 150. For example, the gas or other material can chemically interact with the steam-production material. Such an interaction (i.e., chemical activation) can be used in combination with or in lieu of thermal activation. Other activation methods, which may or may not use detonation of a shaped charge, include pressure activation and electrical activation. Advantageously, a gas generated at step 190 can be used to supplement the high-pressure gas formed at step 160 to stress the formation at step 170.

It should be appreciated that while the FIG. 3 methodologies are particularly suited for perforating and fracturing a formation in a single trip, embodiments of the present invention can fracture a formation independent of a perforating gun or other wellbore tool.

In certain applications, an oxidizer may be used in conjunction with the gas generating material. Suitable oxidizers include potassium sulfate and potassium benzoate. The oxygen released by the oxidizers can combine with a metal fuel such as zinc and/or with carbon or hydrogen (e.g., rubber). Also, materials such as calcium sulfate hemihydrate can function as both a hydrate and a high temperature oxidizer. Additionally, material can be used in conjunction with the gas generating material to increase the available heat of reaction. Suitable material includes a metal such as finely divided aluminum.

The foregoing description is directed to particular embodiments of the present invention for the purpose of illustration and explanation. It will be apparent, however, to one skilled in the art that many modifications and changes to the embodiment set forth above are possible without departing from the scope of the invention. Thus, it is intended that the following claims be interpreted to embrace all such modifications and changes.

What is claimed is:

1. An apparatus for perforating and fracturing a formation, comprising:

a plurality of shaped charges;

a charge tube configured to receive the plurality of shaped charges;

a detonator cord, wherein the detonator cord is operatively coupled with the plurality of shaped charges and configured to detonate the plurality of shaped charges;

a gas generator internal to the charge tube and external to the plurality of shaped charges, wherein the gas generator is configured to be activated by carbon and energy released by the detonation of the plurality of shaped charges; and a carrier tube configured to receive the charge tube.

2. The apparatus of claim 1, wherein the gas generator is formed of a material that releases water when activated by thermal energy.

3. The apparatus of claim 1, wherein the gas generator included an oxidizer.

4. The apparatus of claim 1, wherein the plurality of shaped charges are configured to release a material that activates the gas generator.

5. A method for perforating and fracturing a formation, comprising:

positioning a gas generator internal to a charge tube and external to a plurality of shaped charges affixed to the charge tube;

initiating a detonation of the plurality of shaped charges;

creating a plurality of perforating jets penetrating the formation to form perforations in the formation;

releasing thermal energy by the detonation of the plurality of shaped charges;

creating a high-pressure gas by using carbon, the thermal energy released by the detonation of the plurality of shaped charges, and the gas generator; and stressing the perforations using the high-pressure gas.

6. The method according to claim 5, further comprising: increasing an available heat by using aluminum.

* * * * *